US010926271B2

(12) United States Patent
Corminboeuf et al.

(10) Patent No.: US 10,926,271 B2
(45) Date of Patent: Feb. 23, 2021

(54) GRINDING DEVICE FOR A HIGH GRINDING RATE AND FOR A VARIABLE DISTRIBUTION OF GROUND PARTICLE SIZES

(71) Applicant: FREWITT FABRIQUE DE MACHINES SA, Granges-Paccot (CH)

(72) Inventors: Glenn Corminboeuf, Domdidier (CH); Antoine Virdis, Ferpicloz (CH)

(73) Assignee: FREWITT FABRIQUE DE MACHINES SA, Granges-Paccot (CH)

( * ) Notice: Subject to any disclaimer, the term of this patent is extended or adjusted under 35 U.S.C. 154(b) by 186 days.

(21) Appl. No.: 16/170,226

(22) Filed: Oct. 25, 2018

(65) Prior Publication Data

US 2019/0151859 A1 May 23, 2019

(30) Foreign Application Priority Data

Nov. 17, 2017 (CH) ..... 01394/17

(51) Int. Cl.
*B02C 23/16* (2006.01)
*B02C 18/06* (2006.01)
*B02C 18/10* (2006.01)

(52) U.S. Cl.
CPC ..... *B02C 23/16* (2013.01); *B02C 18/062* (2013.01); *B02C 18/10* (2013.01); *B02C 2023/165* (2013.01)

(58) Field of Classification Search
CPC . B02C 23/16; B02C 2023/165; B02C 18/062; B02C 18/10
USPC ..... 241/74
See application file for complete search history.

(56) References Cited

U.S. PATENT DOCUMENTS 1,286,831 A * 12/1918 Sturtevant ..... B02C 13/284 241/88.4
3,352,500 A * 11/1967 Raab ..... B02C 17/183 241/74
3,737,110 A * 6/1973 Neidl ..... B01D 21/0012 241/43
4,487,371 A * 12/1984 Day ..... B02C 18/2216 241/282.1
5,765,767 A * 6/1998 Iwata ..... B07B 1/06 241/286
2004/0056128 A1 3/2004 Uebayashi

OTHER PUBLICATIONS

Search Report issued in Swiss Patent Application No. 13942017 dated Apr. 24, 2016.

* cited by examiner

*Primary Examiner* — Faye Francis
(74) *Attorney, Agent, or Firm* — Pearne & Gordon LLP

(57) ABSTRACT

A grinding device including a rotor, mounted in rotational manner around an axle and having a plurality of blades extending radially relative to the axle. A sieve has a plurality of openings, with the sieve being mounted around the rotor so as to turn around the axle in the direction opposite the direction of rotation of the rotor. The rotor and sieve each has a height extending parallel to the axle and a width extending perpendicular to the axle wherein the width is between 1 mm and 20 mm. The rotation of the rotor and of the sieve is adjustable so as to reach a difference in circumferential speed between the rotor and the sieve between 100 m/s and 400 m/s, so as to reduce the average initial size of the crushed matter by a factor of 5 to 20.

14 Claims, 4 Drawing Sheets

GRINDING DEVICE FOR A HIGH GRINDING RATE AND FOR A VARIABLE DISTRIBUTION OF GROUND PARTICLE SIZES

TECHNICAL FIELD

The present invention concerns a grinding device, comprising a rotor and a sieve, allowing for a high grinding rate and for a variable distribution of ground particle size.

STATE OF THE ART

Generally, known systems for processing, by grinding, a material such as a solid or powder substance intended for the manufacture of a pharmaceutical, food or other product, using a rotor mounted in rotational manner against a filtering part or sieve. The material to be granulated is smashed by the rotor and/or pressed between the rotor and the sieve. The sieve allows the crushed matter to be sorted while it flows through the openings.

The sieves are generally static. They classify the materials by making them go through openings that separate them according to the size of the particles.

The desired properties of the ground material, such as the grain size of the particles and the flow rate of the particles, can be obtained by selecting in an adequate manner the appropriate grinding parameters, such as the rotational speed of the rotor and the size of the sieve openings (more or less fine mesh). The distribution of the size of the ground particles that go through the sieve depends on the openings of the sieve.

The correct selection of the appropriate grinding parameters is also critical for avoiding a considerable increase of the temperature which could be detrimental to the quality of the crushed matter. Another problem is to achieve a high throughput rate of the crushed matter through increasingly smaller openings.

The use of sieves for separating increasingly finder powders consequently increases the risks of blocking, as the surface tension of such powders causes them to adhere on the cloth mesh and thus leads to the latter quickly becoming clogged up.

BRIEF SUMMARY OF THE INVENTION

The present invention relates to a grinding device for implementing a grinding operation, with the device comprising a grinding chamber designed to receive matter to be crushed having an average initial size; a rotor, mounted in the chamber in rotational manner around an axle and comprising a plurality of blades extending radially relative to the axle; and a sieve comprising a plurality of openings and configured for classifying and/or splitting the matter crushed by the rotor; with the sieve being mounted around the rotor so as to turn around the axle in the direction opposite the direction of rotation of the rotor; with each of the openings having a height extending parallel to the axle and a width extending perpendicular to the axle and comprised between 1 mm and 20 mm; and with the rotation of the rotor and that of the sieve being adjustable so as to supply a difference in peripheral speed between the rotor and the sieve comprised between 100 m/s and 400 m/s, so as to reduce the average initial size of the crushed matter by a factor of 5 to 20.

This solution has notably the advantage over the prior art of allowing for a high grinding rate and for a variable distribution of ground particle size by varying the relative speed between the rotor and the sieve. A considerable reduction of the temperature of the crushed matter can also be achieved.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
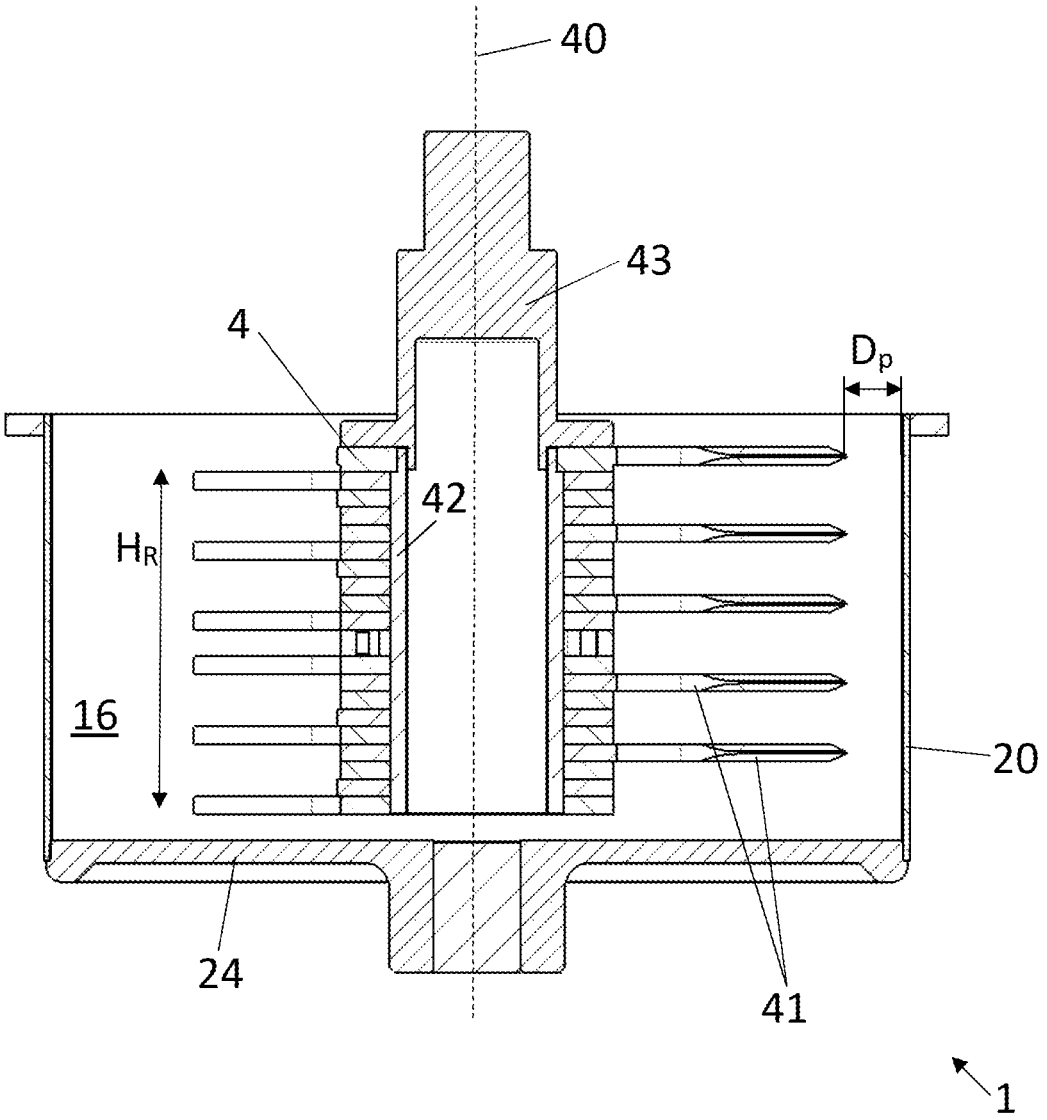
FIG. 1 shows a cross-sectional view of a grinding device 1 comprising a rotor and a sieve, according to one embodiment.

FIG. 1 shows a cross-sectional view of a grinding device 1 according to one embodiment. The device 1 comprises a grinding chamber 16 designed to receive matter to be crushed having an average initial size. The device 1 also comprises a rotor 4, mounted in the chamber 16 in rotational manner around an axle 40. The rotor 4 extends axially along the axle 40 and comprises a plurality of blades 41 extending radially, perpendicular to the axle 40. The rotor 4 is configured for grinding the material when rotating.

In the example illustrated, the rotor 4 is configured vertically in the grinding chamber 16 and has a height $H_R$. The blades 41 extend from a hub 42. The rotor 4 is mounted integrally united (possibly in a removable fashion) on a shaft 43 that can be driven in rotation by a driving mechanism (not represented). The blades 41 extend radially, i.e. in a direction substantially perpendicular to the axle 40.

The device 1 also comprises a sieve 20 mounted around the rotor 4. The sieve 20 is configured for classifying and/or splitting the crushed matter by the rotor 4. The sieve 20 is advantageously mounted in rotational matter around the axle 40. In the particular example of FIG. 1, the sieve 20 is mounted in rotational manner and concentric with the axle 40. The sieve 20 is supported by a base 24 that can be driven in rotation by a driving mechanism (not represented). The driving mechanism driving the sieve 20 can be the same as that driving the rotor 4 or can be different.

Figure 2:
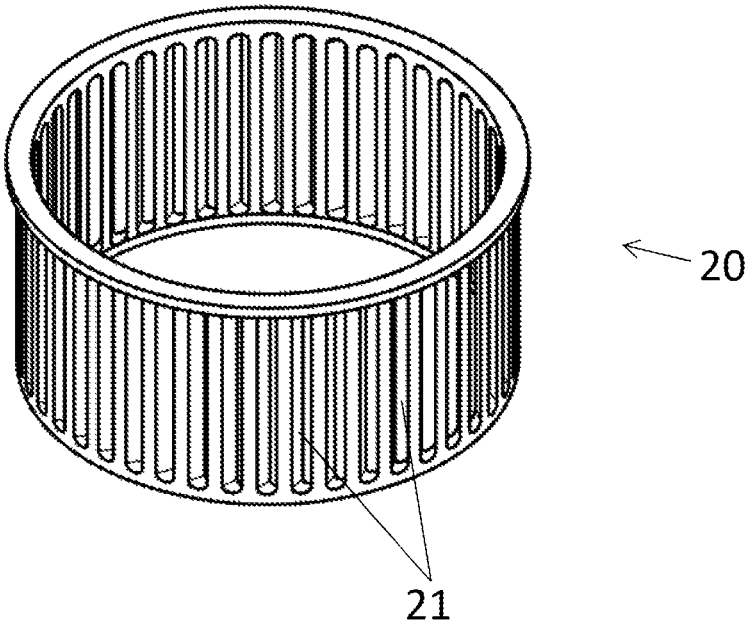
FIG. 2 shows a perspective view of the sieve, according to one embodiment.
Figure 3:
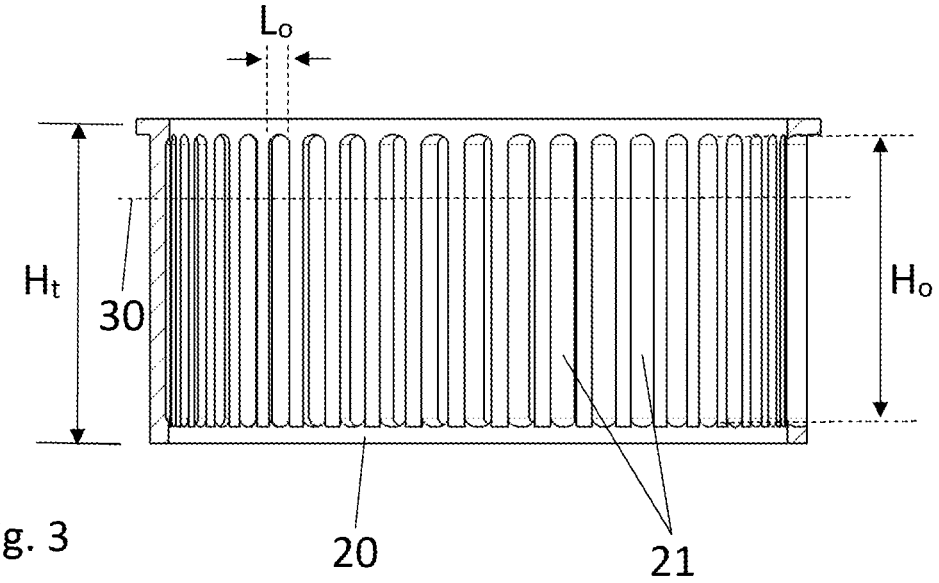
FIG. 3 shows a side view of the sieve, according to one embodiment.

FIG. 2 shows a perspective view and FIG. 3 shows a side view of the sieve 20, according to a preferred embodiment. According to the example illustrated, the sieve 20 has a cylindrical shape and comprises a plurality of openings 21 distributed in substantially equal manner along the periphery of the sieve 20. Each of the openings 21 extends substantially parallel to the axle 40. According to a preferred embodiment, the height $H_o$ of the openings 21 is substantially equal to the height $H_t$ of the sieve 20.

Practical tests have shown that by varying the rotation speed of the rotor 4 and that of the sieve 20, very different granulometric results can be achieved.

According to a preferred embodiment, the width $L_o$ of the openings 21 is comprised between 1 mm and 20 mm. The rotation of the rotor 4 and of the sieve 20 can be adjusted so as to reach a difference in the peripheral speed between the rotor 4 and the sieve 20 that is comprised between 100 m/s and 400 m/s. This combination allows the average initial size of the crushed matter to be reduced by a factor going from 5 to 20 times, depending on the difference of the peripheral speed and the width $L_o$ of the openings 21.

A conventional hammer grinding device would have required several different sieves to obtain such a variety of results.

According to an advantageous embodiment, the width $L_o$ of the openings 21 can be comprised between 4 mm and 8 mm.

The width $L_o$ of the openings 21 is thus considerably greater than the openings of a static sieve used in a conventional hammer grinding device.

Figure 4:
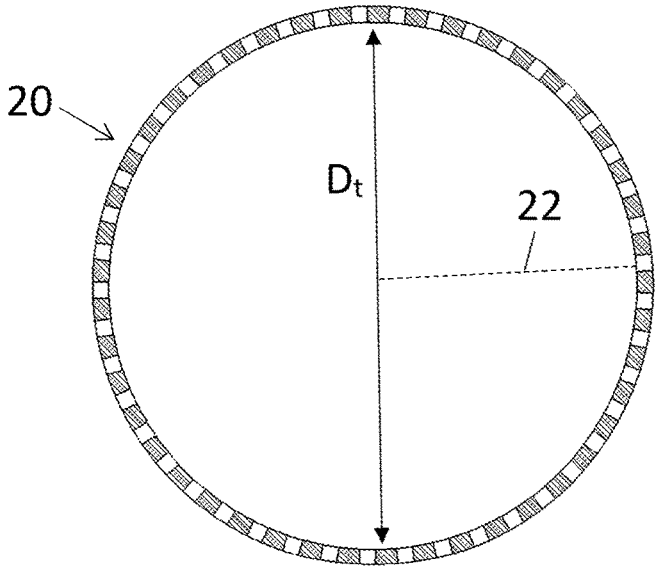
FIG. 4 shows a transverse cross-sectional view of the sieve, according to one embodiment.
Figure 5:
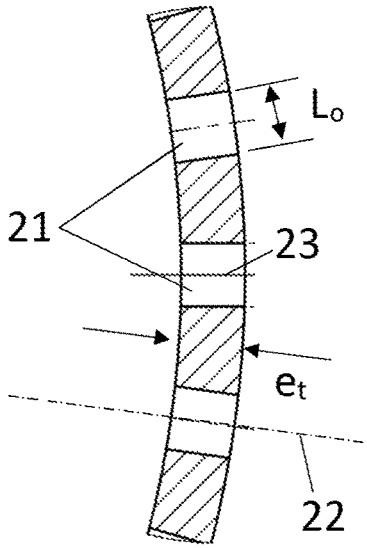
FIG. 5 shows a transverse cross-sectional view of a portion of the sieve of FIG. 4.

FIG. 4 shows a transverse cross-sectional view (i.e. along the plane defined by 30 in FIGS. 1 and 3), according to one embodiment. FIG. 5 shows a transverse cross-sectional view of a portion of the sieve 20 of FIG. 4.

The thickness $e_t$ of the sieve 20 can be chosen according to the width $L_o$ of the openings 21 so as to obtain an impact effect on the particles of material. In a preferred manner, the sieve 20 has a thickness $e_t$ substantially equal to the width $L_o$ of the openings 21.

The openings 21 can be oriented substantially radially. In the example illustrated in FIGS. 4 and 5, the radial orientation of the openings 21 is illustrated by the coincidence of a radius 22 from the center of the sieve 20 with the axis 23 of the opening 21.

Figure 6:
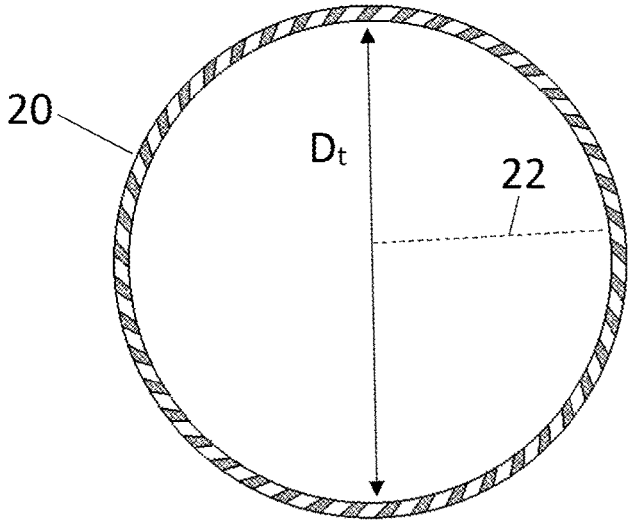
FIG. 6 shows a transverse cross-sectional view of the sieve, according to another embodiment.
Figure 7:
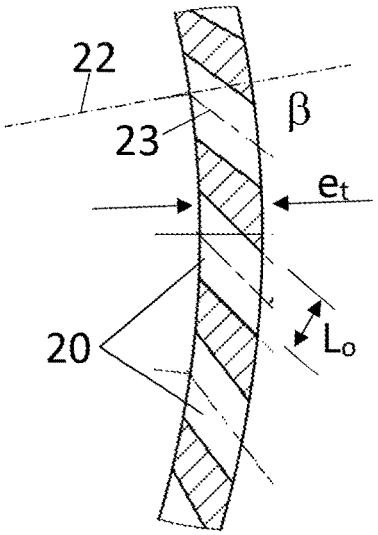
FIG. 7 shows a transverse cross-sectional view of a portion of the sieve of FIG. 6.

FIG. 6 shows a transverse cross-sectional view of the sieve 20, according to another embodiment. FIG. 7 shows a transverse cross-sectional view of a portion of the sieve 20 of FIG. 6. In this configuration, the openings 21 are oriented with a tilt angle comprised between −60° and 60°, relative to the radial direction of the sieve 20. This configuration allows a better separation between finely ground particles and the coarse particles that have not been sufficiently ground yet.

According to a variant embodiment, the difference in peripheral speed between the rotor 4 and the sieve 20 is comprised between 200 m/s and 300 m/s.

The sieve 20 is configured for turning in the direction opposite the direction of rotation of the rotor 4.

Advantageously, the peripheral speed of the rotor 4 is preferably of the order of 50 m/s to 200 m/s, and more advantageously of 150 m/s to 200 m/s.

Advantageously, the peripheral speed of the sieve 20 is preferably of the order of 20 m/s to 20 m/s, and more advantageously of 50 m/s to 150 m/s.

Figure 8:
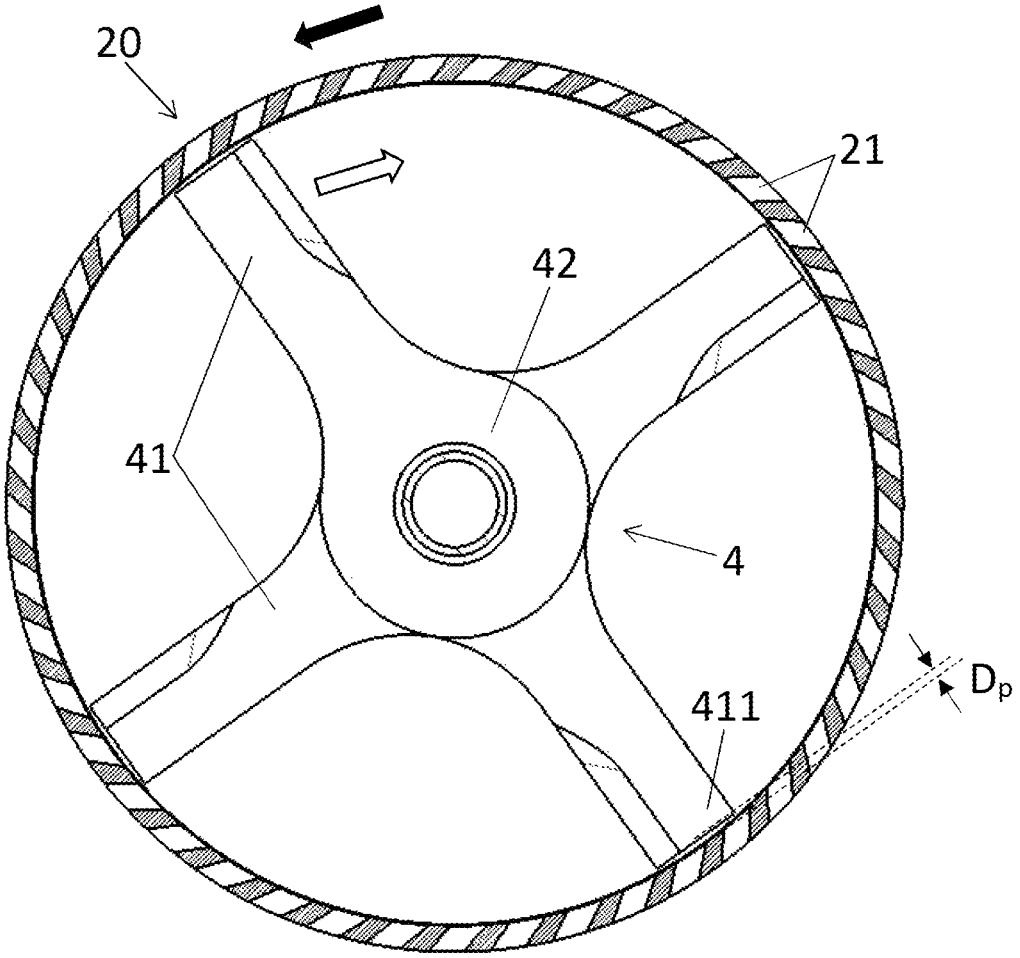
FIG. 8 represents a transverse cross-sectional view of the sieve 20 and of the rotor 4, according to one embodiment.

FIG. 8 represents a transverse cross-sectional view of the sieve 20 and of the rotor 4, according to one embodiment. The distance $D_p$ between the distal extremity 411 of the blades 41 of the rotor and the inside diameter of the sieve 20 should be as small as possible for an optimal splitting of the material ground by the rotor 4 whilst avoiding causing local heat build-ups. This distance $D_p$ is also a function of the size of the non-crushed particles. Advantageously, the distance $D_p$ between the distal extremity of the blades 41 and the inner radial dimension $D_t$ of the sieve 20 is comprised between 0.5 mm to 5 mm. In the example of FIG. 8, the direction of rotation of the rotor 4 is indicated by the empty arrow and the direction of rotation of the sieve 20 is indicated by the full arrow.

It goes without saying that the present invention is not limited to the embodiment that has just been described and that various modifications and simple variants can be conceived of by the one skilled in the art without falling outside the scope of the present invention.

For example, the sieve 20 can have another shape than the illustrated cylindrical shape. It is indeed possible for the sieve 20 to have a conical shape, a U shape or any other appropriate shape. The rotor 4 can also have a configuration different from that illustrated. For example, in a variant that is not represented, the rotor 4 can comprise two discs at both extremities of the hub 42 and between which the blades extend.

According to one embodiment, the axial dimension (height) $H_t$ of the sieve 20 is substantially equal to half the radial dimension (diameter) $D_t$ of the sieve 20 or substantially equal to the radial dimension $D_t$ of the sieve 20.

The axial dimension $H_t$ of the sieve 20 can be substantially equal to the height $H_R$ of the rotor 4, smaller or greater.

The grinding device 1 of the invention makes it possible to achieve the following advantages as compared with a conventional hammer grinding device, notably: a considerable reduction of the temperature of the product exiting the process; an interesting increase of the product rate, notably thanks to the absence of risk of clogging the rotating drum with large openings; and the variation of the rotation speed of the drum also allows the width of distribution of ground particle size to be influenced positively.

The proposed grinding device 1 allows more parameters to be adjusted than in the case of a traditional mill, without however requiring a mechanical intervention on the mill by changing parts. Indeed, by exploiting the speed of rotation of the rotor 4 and of the sieve 20, as well as their respective directions of rotation, different phenomena can be created and, thus, different grinding results can be achieved.

The rotating sieve 20 can notably generate either an aspiration effect or push the large particles back towards the rotor 4 or cause additional collisions with particles of product, depending on the choice of the direction of rotation, the size of the openings 21 and the tilt angle β of the openings 21.

The openings 21 of the turning sieve 20 are generally rather large relative to the openings of a traditional sieve. However, the contrary rotation of the sieve 20 relative to the rotor 4 produces a dynamic reduction effect of the size of the openings 21. In other words, the openings 21 function as if they had a (dynamic) size lower than their effective size. The dynamic reduction effect of the size of the openings 21 furthermore makes it possible to push back and/or maintain the large particles in the grinding zone (grinding chamber 16). The dynamic reduction effect of the size of the openings 21 also allows the number of collisions between the particles to be multiplied, which thus allows even finer ground particle sizes to be obtained than without this effect. The dynamic reduction effect depends on the direction of rotation of the sieve 20, on the size of the openings 21 and on the angle β of the openings 21, bearing in mind that the relative speeds between the sieve 20 and the rotor 4 are much higher than in ordinary mills.

REFERENCE NUMBERS USED IN THE FIGURES

1 device
16 grinding chamber

2 grinding unit
20 20 sieve
21 openings
22 radius
23 axis
24 base
3 body
30 plane
4 rotor
40 axle
41 blade
411 distal extremity of the blade
42 hub
43 shaft
β tilt angle
$D_p$ distance
$D_t$ diameter of the sieve, radial dimension
$e_t$ thickness
$H_o$ height of the openings
$H_R$ rotor height
$H_t$ height of the sieve, axial dimension
$L_o$ width of the openings

The invention claimed is:

1. Grinding device for implementing a grinding operation, the device comprising:

a grinding chamber designed to receive matter to be crushed having an average initial size;

a rotor, mounted in the chamber in rotational manner around an axle and comprising a plurality of blades extending radially relative to the axle; and a sieve comprising a plurality of openings and configured for classifying and/or splitting the matter crushed by the rotor;

the sieve being mounted around the rotor so as to turn around the axle in the direction opposite the direction of rotation of the rotor;

each of the openings having a height extending parallel to the axle and a width extending perpendicular to the axle and comprised between 1 mm and 20 mm;

and the rotation of the rotor and that of the sieve being adjustable so as to supply a difference in peripheral speed between the rotor and the sieve comprised between 100 m/s and 400 m/s, so as to reduce the average initial size of the crushed matter by a factor of 5 to 20.

2. Device according to claim 1, wherein the width of the openings is comprised between 4 mm and 8 mm.

3. Device according to claim 1, wherein the sieve has a thickness equal to the width of the openings.

4. Device according to claim 1, wherein the height of the openings is equal to the axial dimension of the sieve.

5. Device according to claim 4, wherein the axial dimension of the sieve is equal to half of the radial dimension of the sieve or equal to the radial dimension of the sieve.

6. Device according to claim 1, wherein the openings are oriented radially.

7. Device according to claim 6, wherein the openings are oriented with a tilt angle between −60° and 60° relative to the radial direction of the sieve.

8. Device according to claim 1, wherein the sieve is configured for turning in the same direction as the rotor or in the opposite direction.

9. Device according to claim 8, wherein the peripheral speed of the rotor is of the order of 50 m/s to 200 m/s.

10. Device according to claim 8, wherein the peripheral speed of the sieve is of the order of 20 m/s to 200 m/s.

11. Device according to claim 8, wherein the difference of peripheral speed of the rotor and of the sieve is comprised between 200 m/s to 300 m/s.

12. Device according to claim 8, wherein the peripheral speed of the rotor is of the order of 150 m/s to 200 m/s.

13. Device according to claim 8, wherein the peripheral speed of the sieve is of the order of 50 m/s to 150 m/s.

14. Device according to claim 1, wherein the distance between the distal extremity of the blades and the inner radial dimension of the sieve is between 0.5 mm to 5 mm.

* * * * *